US009144318B1

(12) United States Patent
Lagier

(10) Patent No.: US 9,144,318 B1
(45) Date of Patent: Sep. 29, 2015

(54) INFLATABLE, FLOATABLE, MODULAR FURNITURE SYSTEM

(71) Applicant: Pigro Felice Ltd.

(72) Inventor: Julien Lagier, Beirut (LB)

(73) Assignee: PIGRO FELICE LTD., Hong Kong (HK)

( * ) Notice: Subject to any disclaimer, the term of this patent is extended or adjusted under 35 U.S.C. 154(b) by 0 days.

(21) Appl. No.: 14/457,669

(22) Filed: Aug. 12, 2014

(51) Int. Cl.
*B63B 35/74* (2006.01)
*A47C 15/00* (2006.01)
*A47C 4/54* (2006.01)

(52) U.S. Cl.
CPC ..... *A47C 15/006* (2013.01); *A47C 4/54* (2013.01); *B63B 35/74* (2013.01)

(58) Field of Classification Search
CPC ..... A47C 15/006; B63B 35/74
USPC ..... 441/130, 129; 297/452.41, 111, 114; 5/655
See application file for complete search history.

(56) References Cited

U.S. PATENT DOCUMENTS

| | | | | |
|---|---|---|---|---|
| 2,623,574 | A * | 12/1952 | Damsch | 297/111 |
| 2,843,181 | A * | 7/1958 | Paschen | 297/114 |
| 3,572,836 | A * | 3/1971 | Khanh | 297/452.41 |
| 4,459,714 | A * | 7/1984 | Lin | 5/655.3 |
| 4,687,452 | A * | 8/1987 | Hull | 441/131 |
| 4,905,332 | A | 3/1990 | Wang | |
| D371,252 | S | 7/1996 | Chaput | |
| 5,560,056 | A * | 10/1996 | Tai | 5/120 |
| 5,566,409 | A | 10/1996 | Klearman | |
| 5,951,111 | A * | 9/1999 | Klimenko | 297/452.41 |
| 6,036,555 | A * | 3/2000 | Takacs | 440/6 |
| 6,042,186 | A * | 3/2000 | Kojic et al. | 297/452.41 |
| D434,243 | S | 11/2000 | Casto et al. | |
| 6,152,530 | A * | 11/2000 | Hsu et al. | 297/272.3 |
| 6,224,444 | B1 * | 5/2001 | Klimenko | 441/130 |
| 7,104,864 | B1 | 9/2006 | Liou | |
| 7,131,701 | B1 * | 11/2006 | Yang | 297/452.41 |
| 7,231,681 | B2 | 6/2007 | Kasatshko et al. | |
| 7,246,393 | B2 * | 7/2007 | Westendorf et al. | 5/706 |
| 7,331,074 | B2 * | 2/2008 | Wu | 5/706 |
| 7,370,379 | B2 * | 5/2008 | Zheng | 5/655.3 |
| 7,555,797 | B1 * | 7/2009 | Wu | 5/710 |
| 8,371,888 | B2 * | 2/2013 | To | 441/130 |
| 2005/0099054 | A1 * | 5/2005 | McCarthy et al. | 297/452.41 |
| 2006/0163935 | A1 * | 7/2006 | Harris | 297/452.41 |
| 2010/0229960 | A1 | 9/2010 | Merker et al. | |

FOREIGN PATENT DOCUMENTS

| | | | |
|---|---|---|---|
| JP | H0397417 | A | 4/1991 |

* cited by examiner

*Primary Examiner* — Lars A Olson
*Assistant Examiner* — Jovon Hayes
(74) *Attorney, Agent, or Firm* — Michael F. Hoffman; Hoffman Warnick LLC

(57) ABSTRACT

An inflatable furniture system. In one aspect, the disclosed system includes: a pair of interchangeable inflatable cushions, wherein a bottom surface of each cushion includes a plurality of attachment loops affixed thereto; a substantially H-shaped inflatable arm/back rest that includes a bottom surface having a plurality of attachment loops affixed thereto; a plurality of extension straps, each with two ends, wherein each end includes an attachment loop; and a plurality of S-clips, each configured to connect a pair of attachment loops.

20 Claims, 15 Drawing Sheets

INFLATABLE, FLOATABLE, MODULAR FURNITURE SYSTEM

TECHNICAL FIELD

The subject matter of this invention relates generally to an inflatable and floatable modular furniture system.

BACKGROUND

There exist numerous types and styles of inflatable furniture. There also exist various types of inflatable floatable furniture for use in or out of a pool or body of water. Moreover, there exist modular inflatable furniture systems. However, none of the existing designs provides an inflatable, floatable, modular furniture system that is truly stylish and functional. In particular, none of the existing designs provide a high end look, while at the same time providing a versatile, comfortable, and easy-to-use system that can be easily transformed into different configurations for use in or out of the water.

SUMMARY

In general, aspects of the present invention provide an inflatable, floatable, modular furniture system.

A first aspect of the invention provides an inflatable furniture system, comprising: a pair of interchangeable inflatable cushion sections that are stackable upon each other to form a seat arrangement having a seat cushion and a support cushion, wherein a bottom surface of each cushion includes a plurality of attachment loops affixed thereto; a substantially H-shaped inflatable arm/back rest that is stackable on the seat cushion and includes a bottom surface having a plurality of attachment loops affixed thereto; a plurality of extension straps, each with two ends, wherein each end includes an attachment loop; a plurality of S-clips, each configured to connect a pair of attachment loops; wherein a first attachment loop of the seat cushion and an adjacent attachment loop of the support cushion are securable with a first pair of S-clips and a first extension strap, and wherein a second attachment loop of the seat cushion and an adjacent attachment loop of the substantially H-shaped inflatable arm/back rest are securable with a second pair of S-clips and a second extension strap.

A second aspect of the invention provides an inflatable furniture system, comprising: a pair of interchangeable inflatable cushions, wherein a bottom surface of each cushion includes a plurality of attachment loops affixed thereto; a substantially H-shaped inflatable arm/back rest that includes a bottom surface having a plurality of attachment loops affixed thereto; a plurality of extension straps, each with two ends, wherein each end includes an attachment loop; and a plurality of S-clips, each configured to connect a pair of attachment loops.

A third aspect of the invention provides an inflatable furniture system, comprising: a pair of interchangeable inflatable cushions; a substantially H-shaped inflatable arm/back rest; an attachment system, wherein the attachment system provides a first mechanism for stackably securing the interchangeable inflatable cushions and substantially H-shaped inflatable arm/back rest in a seat arrangement; and wherein the attachment system provides a second mechanism for horizontally securing the interchangeable inflatable cushions in a lounge arrangement.

A fourth aspect of the invention provides a method for implementing an inflatable furniture system, comprising: providing a pair of interchangeable inflatable cushions, wherein a bottom surface of each cushion includes a plurality of attachment loops affixed thereto; providing a substantially H-shaped inflatable arm/back rest that includes a bottom surface having a plurality of attachment loops affixed thereto; providing a plurality of extension straps, each with two ends, wherein each end includes an attachment loop; providing a plurality of S-clips, each configured to connect a pair of attachment loops; and implementing one of: (a) a seat arrangement by stackably securing a first attachment loop of a first cushion to an adjacent attachment loop of a second cushion with a first pair of S-clips and a first extension strap, and stackably securing a second attachment loop of the first cushion to an adjacent attachment loop of the substantially H-shaped inflatable arm/back rest with a second pair of S-clips and a second extension strap; and (b) a lounge arrangement by horizontally securing a first attachment loop of a first cushion to an adjacent attachment loop of a second cushion with only a single S-clip.

BRIEF DESCRIPTION OF THE DRAWINGS

These and other features of this invention will be more readily understood from the following detailed description of the various aspects of the invention taken in conjunction with the accompanying drawings in which.

Figure 1:
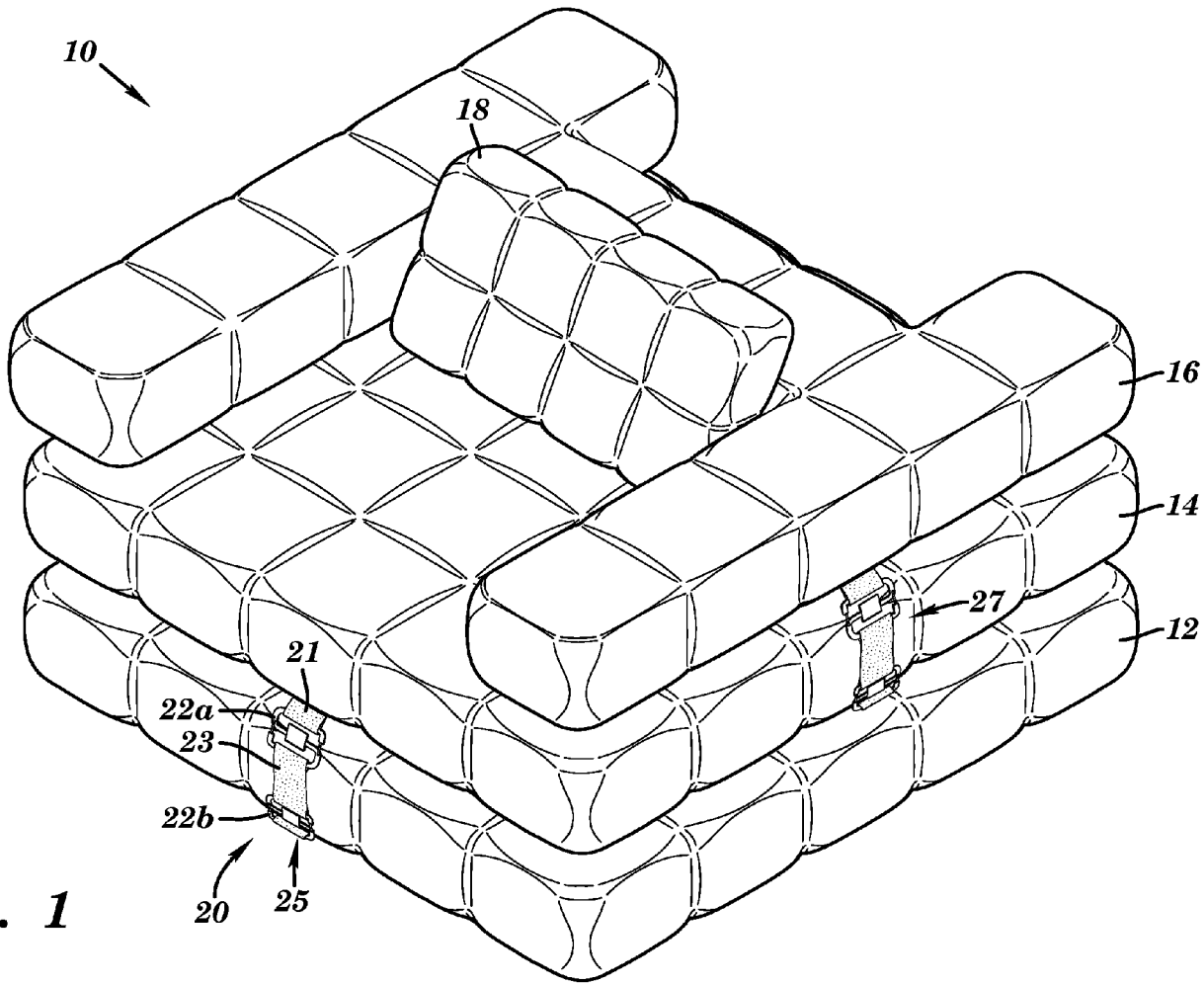
FIG. 1 shows an isometric view of an inflatable furniture system deployed as a chair according to embodiments of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

The present invention provides an inflatable furniture system that utilizes modular inflatable sections and parts that allows each piece of furniture to be converted into different set-ups, be used in or out of water, and/or be combined together with other pieces to form a virtually unlimited number of configurations. For example, FIG. 1 depicts an isometric view of an inflatable side chair system 10 (referred to simply as chair 10) that can, e.g., be converted from the depicted seat arrangement into a lounge arrangement. Chair 10 generally includes a pair of cushions 12 and 14, an H-shaped arm/backrest 16, a pillow 18, and a system for securing the inflatable parts together. In this illustrative embodiment, the pair of cushions 12 and 14 is interchangeable, that is, both cushions 12, 14 are substantially identical to each other. In this embodiment, cushions 12 and 14 have substantially square profiles, thereby allowing them to be rotated 90, 180 or 270 degrees without impacting functionality described herein. Note however, other shapes, e.g., rectangles, polygons, circular, etc., could be employed.

In the depicted "seat" configuration, the second cushion 14 (i.e., the "seat cushion") is stacked on the first cushion 12 (i.e., the "support cushion"). As shown, the first cushion 12 is secured to the second cushion 14 with at least one attachment system 20 at the front of the chair 10. A second, similar attachment system may be utilized at the back of chair 10 (not shown) as an alternative or in addition to further secure cushions 12 and 14 together in this stacked formation. Attachment system 20 generally includes: (1) a first attachment loop 21 affixed to a bottom surface of second cushion 14; a first S-clip 22*a*; an extension strap 23; a second S-clip 22*b*; and a second adjacent attachment loop 25 attached to a bottom surface of the first cushion 12. Component parts of the attachment system 20 are described in further detail with reference to FIGS. 4-6 herein.

H-shaped arm/backrest 16 may be secured to the second cushion 14 in a similar stacked manner with at least one attachment system 27. Namely, an attachment loop on the bottom surface of second cushion 14 is connected to a first S-clip, which is connected to an extension strap, which is connected to a second S-clip, which is connected to an adjacent attachment loop on the bottom surface of the armrest of H-shaped arm/backrest 16. A further attachment system (not shown) may be similarly used on the opposite side of the chair 10 to further secure H-shaped arm/backrest 16 to the second cushion 14.

Figure 2:
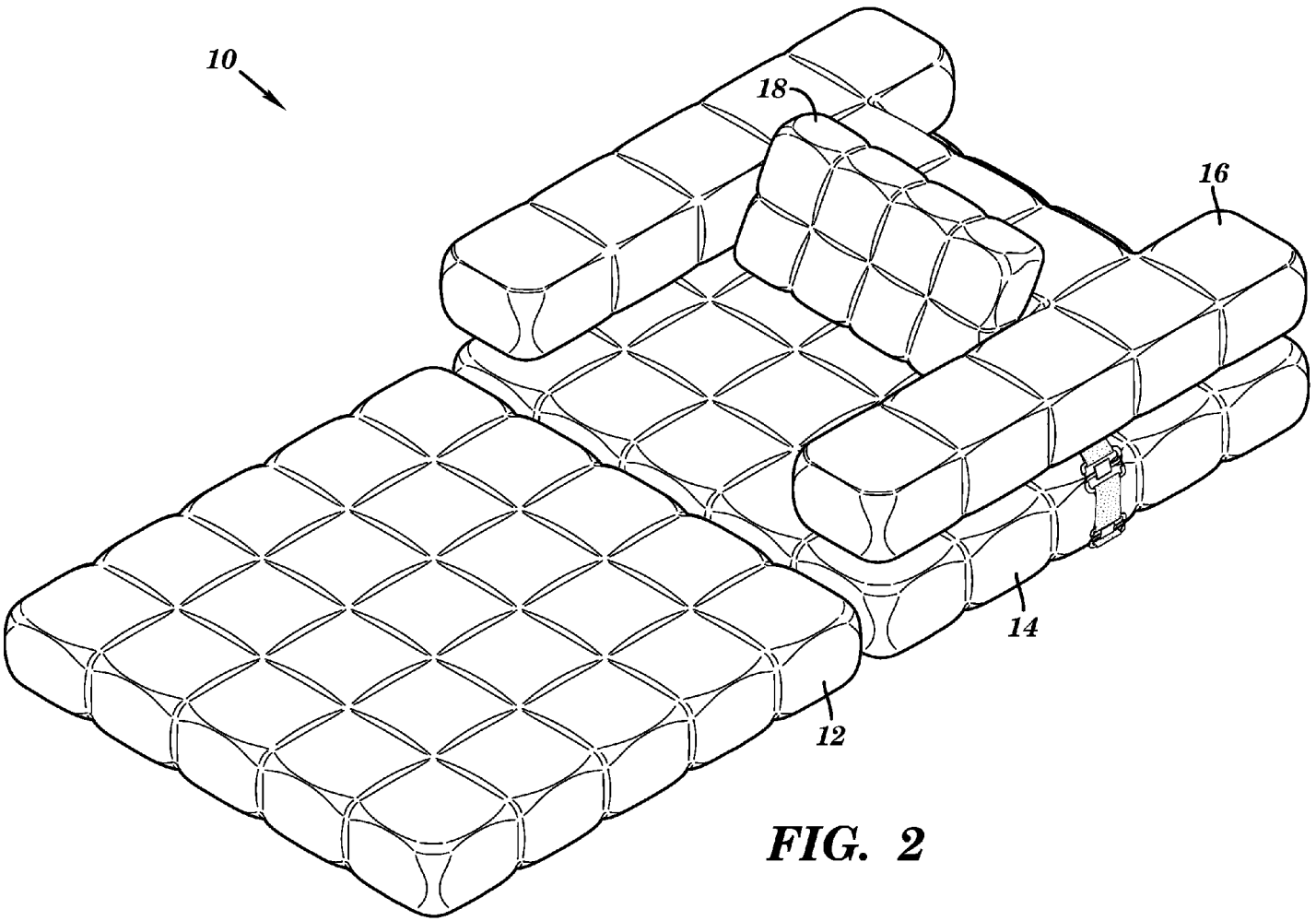
FIG. 2 shows an isometric view of the inflatable furniture system of FIG. 1 deployed as a lounge according to embodiments of the invention.

FIG. 2 depicts an alternate set-up, referred to as a "lounge" configuration, that may be employed for chair 10, e.g., for use in floating on the water. In this configuration, H-shaped arm/backrest 16 is secured to the second cushion 14 as described above. However, first (support) cushion 12 is repositioned to lay horizontal to second (seat) cushion 12 to create a lounge. In the horizontal, versus stacked, position, first cushion 12 is secured edge-to-edge to second cushion 14 as shown in FIG. 3.

Figure 3:
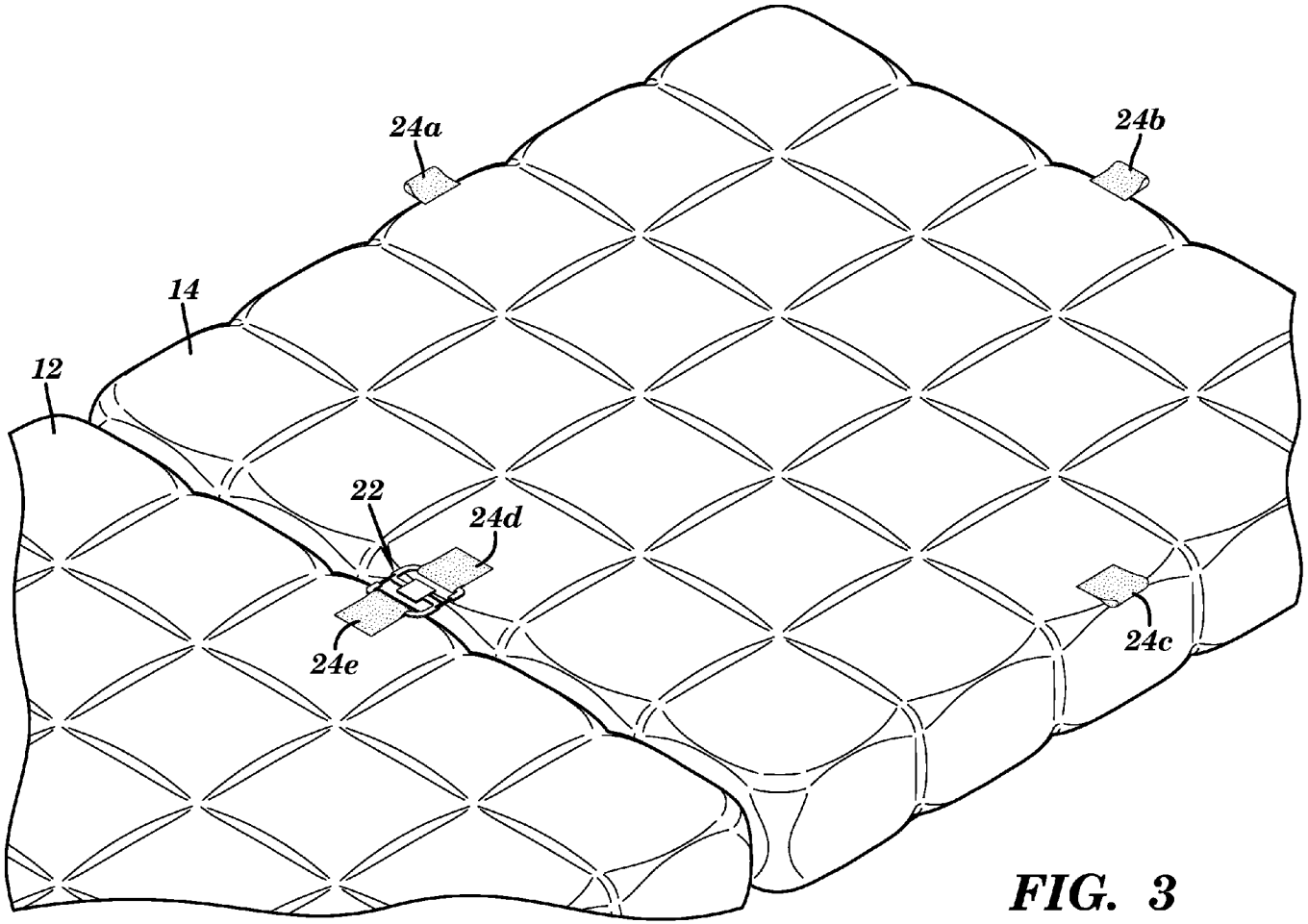
FIG. 3 shows a bottom surface of a pair of horizontally arranged cushions according to embodiments of the invention.

FIG. 3 depicts the bottom surfaces of first cushion 12 and second cushion 14 secured in the horizontal position. In this embodiment, each cushion has a substantially square bottom surface with four edges. As can be seen, cushions 12, 14 each have four attachment loops 24*a*, 24*b*, 24*c*, 24*d* placed along central portions of each of the four edges. Each attachment loop 24*a*, 24*b*, 24*c*, 24*d* is affixed to the surface, e.g., with stitching, adhesive, hook and loop, etc., and includes an opening configured to receive an end of an S-clip. To achieve the horizontal lounge configuration, a single S-clip 22 is utilized to connect adjacent attachment loops 24*b* of the first cushion 12 and 24*e* of the second cushion 14.

Figure 4:
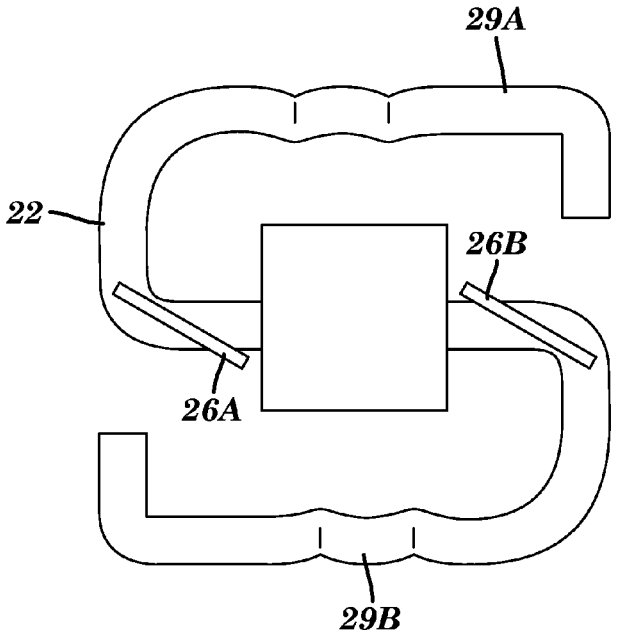
FIG. 4 shows an S-clip according to embodiments of the invention.
Figure 5:
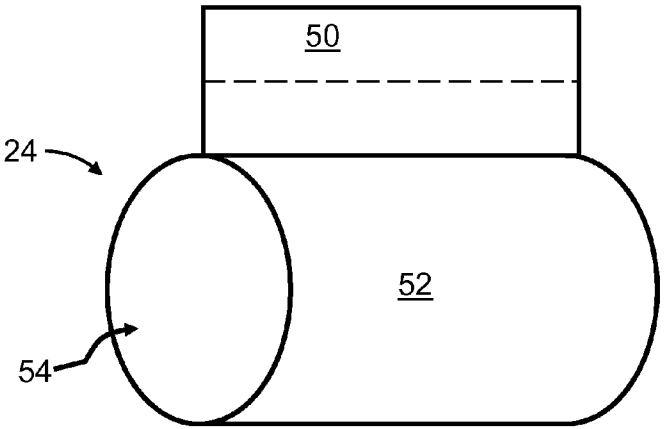
FIG. 5 shows an attachment loop according to embodiments of the invention.
Figure 6:
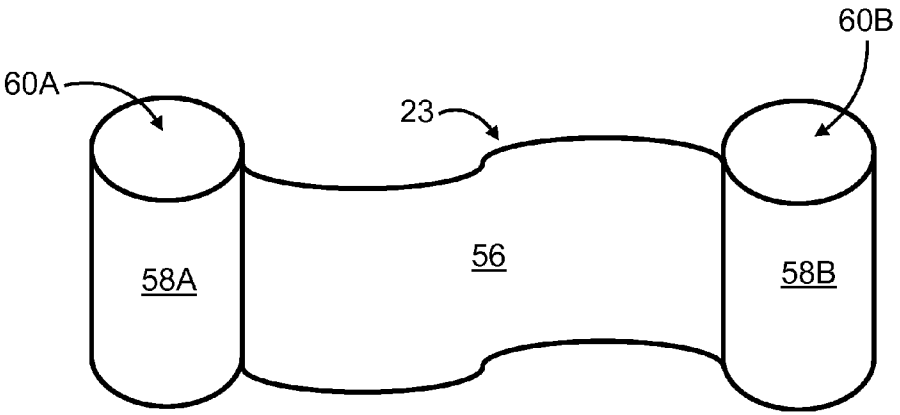
FIG. 6 shows an extension strap according to embodiments of the invention.

FIG. 4 depicts an illustrative S-clip 22, which includes spring-loaded latches 26A, 26B for providing access to parallel receiving elements 29A, 29B. Parallel receiving elements 29A, 29B are thus configured to receive a loop element 52 of an attachment loop 24 (FIG. 5) or a loop element 60A, 60B of an extension strap 23 (FIG. 6). Attachment loop 24 shown in FIG. 5 generally includes a first portion 50 that is affixed to a bottom surface of a chair section and a loop element 52 with an opening 54 that can slide onto a parallel element 29A, 29B of the S-clip 22. Extension strap 23 shown in FIG. 6 generally includes a pair of loop elements 58A, 58B connected with an extension element 56. Each loop element 58A, 58B likewise includes an opening 60A, 60B adapted to receive a parallel element 29A, 29B of the S-clip 22. As shown, e.g., in FIG. 1, the extension strap 23 is utilized as part of an attachment system 20 to secure chair sections in a stacked configuration.

Figure 16:
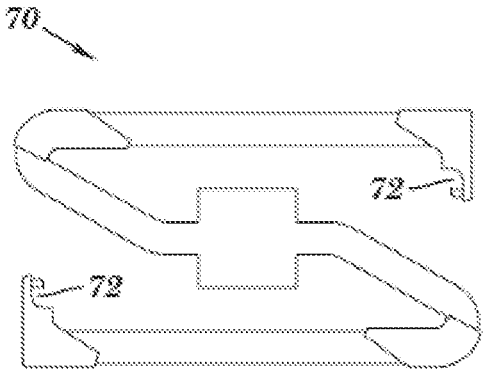
FIG. 16 shows an alternative S-clip according to embodiments of the invention.
Figure 17:
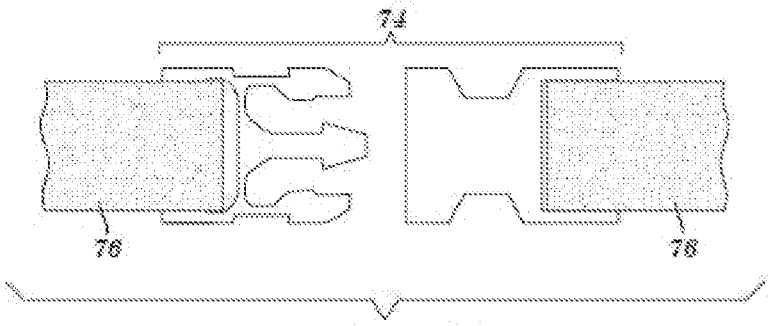
FIG. 17 shows an alternative attachment device according to embodiments of the invention.

FIG. 16 shows an alternative design of an S-clip 70. Rather than utilizing spring loaded latches, S-clip 70 utilizes notches 72 to secure the loop elements of an attachment loop (not shown). FIG. 17 shows a further attachment device 74 that could be employed as an alternative attachment mechanism. Strap portions 76 could be tethered directly to the chair surface (e.g., via stitching, etc.) or be connected to a loop element attached to the chair.

Figure 7B:
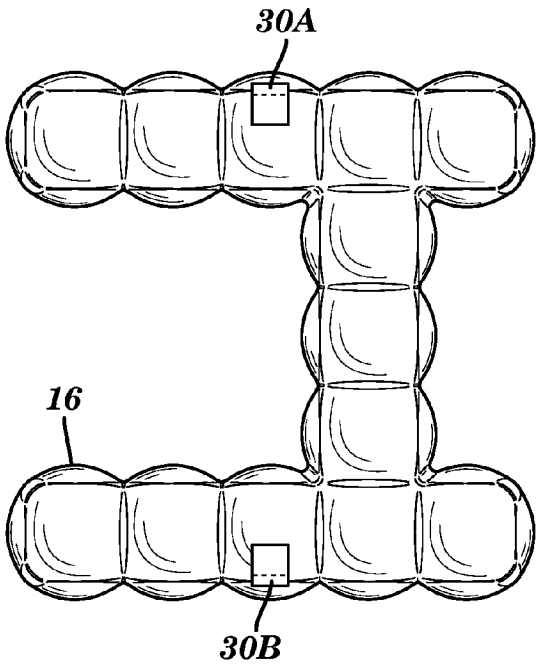
FIGS. 7A and 7B show an H-shaped back/armrest according to embodiments of the invention.
Figure 7A:
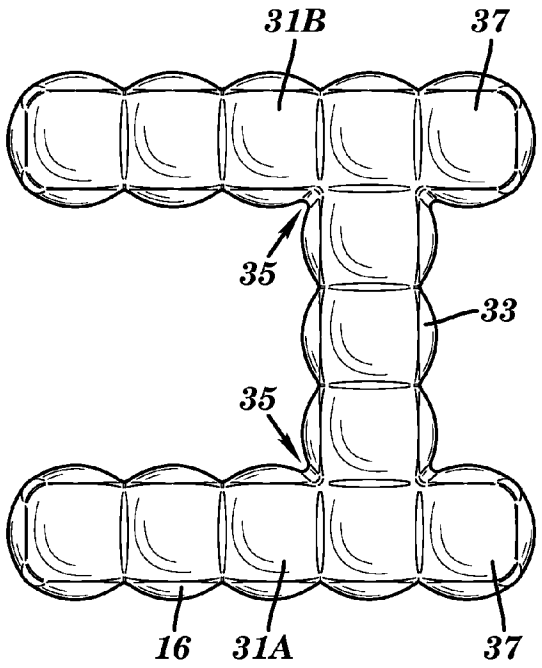

FIGS. 7A and 7B depict top and bottom views, respectively, of an H-shaped arm/backrest 16 or chair 10. As shown, a pair of attachment loops 30A, 30B is affixed to the bottom side of H-shaped arm/backrest 16. These attachment loops 30A, 30B are utilized to secure H-shaped arm/backrest 16 to the upper cushion 14 as shown in FIG. 1. H-shaped arm/backrest 16 is unique in that it includes two substantially straight armrests 31A, 31B arranged perpendicular to a substantially straight backrest 33, wherein the backrest 33 meets each of the armrests 31A, 31B along a central portion 35 (versus and end portion 37) of each armrest. Thus, when stacked on a cushion (not shown), the backrest 33 is not positioned at the back of the cushion, but more centrally to provide better support and comfort.

Figure 8:
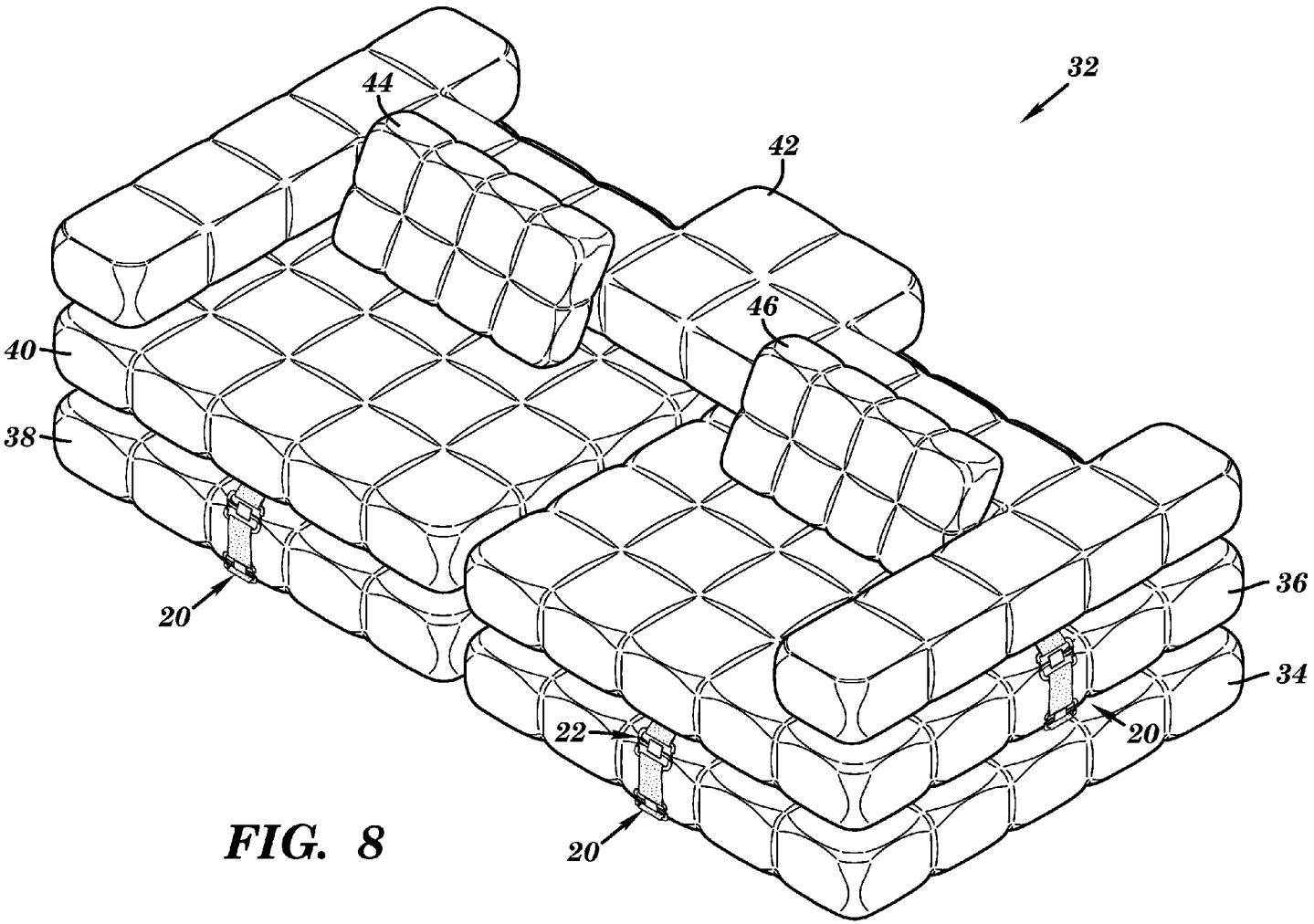
FIG. 8 shows an isometric view of an inflatable furniture system deployed as a sofa according to embodiments of the present invention.

FIG. 8 depicts an inflatable sofa system 32 (also referred to herein as sofa 32) that provides similar functionality to chair 10. Sofa 32 generally includes four substantially interchangeable cushions 34, 36, 38 and 40, a modified H-shaped back arm/backrest 42; pillows 44, 46 and a plurality of attachment systems 20 for securing stacked sofa sections in the same manner as described above for chair 10. Namely, attachment loops on the bottom of the seat cushion 36 and adjacent attachment loops on the bottom of the support cushion 34 are each securable with a pair of S-clips and an extension strap. Similarly, an attachment loop on the bottom of each seat cushion 36, 40 and adjacent attachment loops on the bottom of the substantially H-shaped inflatable arm/back rest are each securable with a pair of S-clips and an extension strap.

Figure 9:
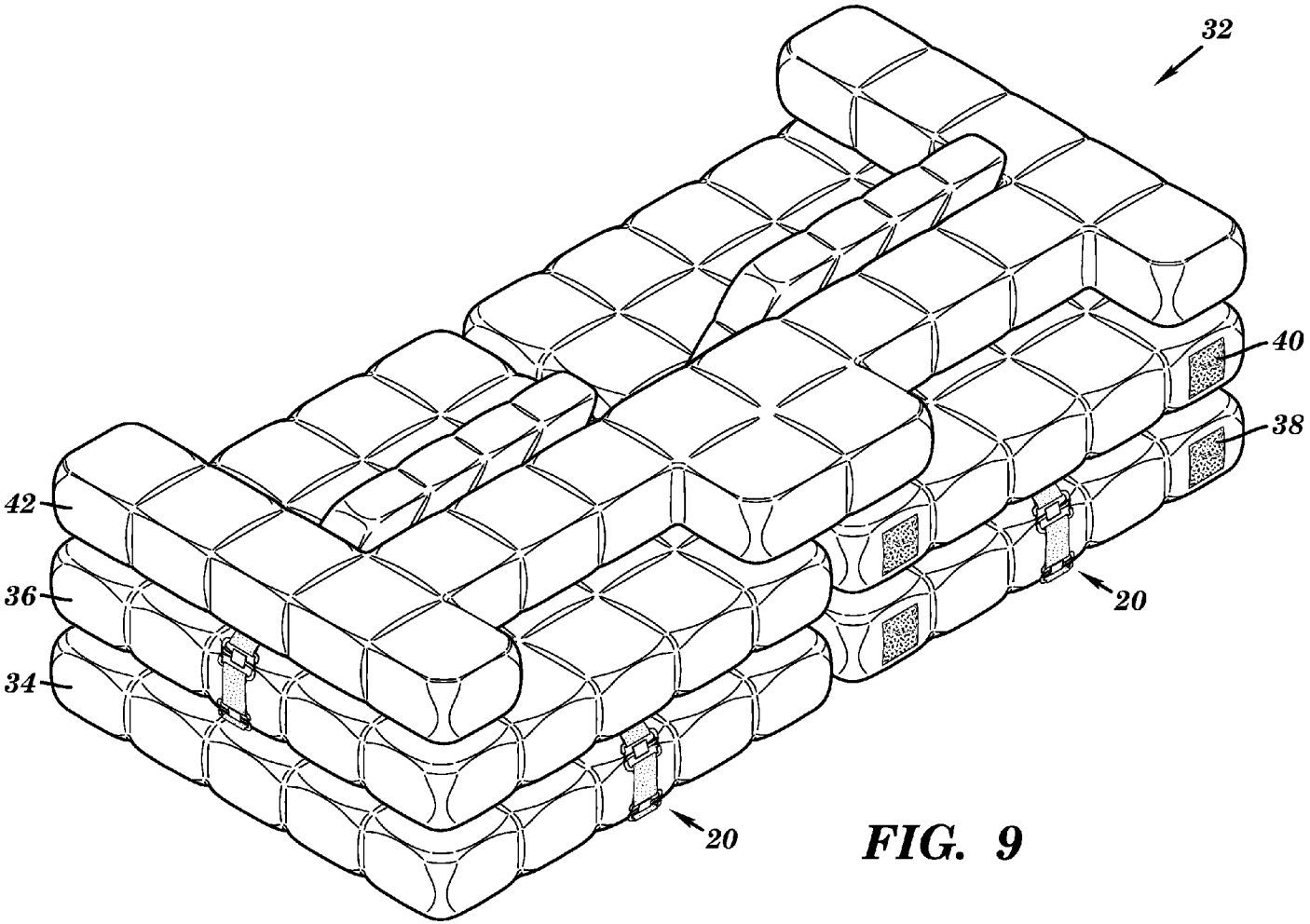
FIG. 9 shows a rear isometric view of the sofa of FIG. 8.

FIG. 9 shows a rear view of sofa 32 showing the use of attachment systems 20 further securing the support cushions 34, 38 to seat cushions 36, 40, respectively. Although not shown, horizontal attachments between adjacent cushion pairs 34, 36 and 38, 40 may be employed beneath the cushions as shown in FIG. 3. For example cushion 34 may be secured to cushion 36 with a single S-clip affixed to adjacent attachment loops.

Figure 10:
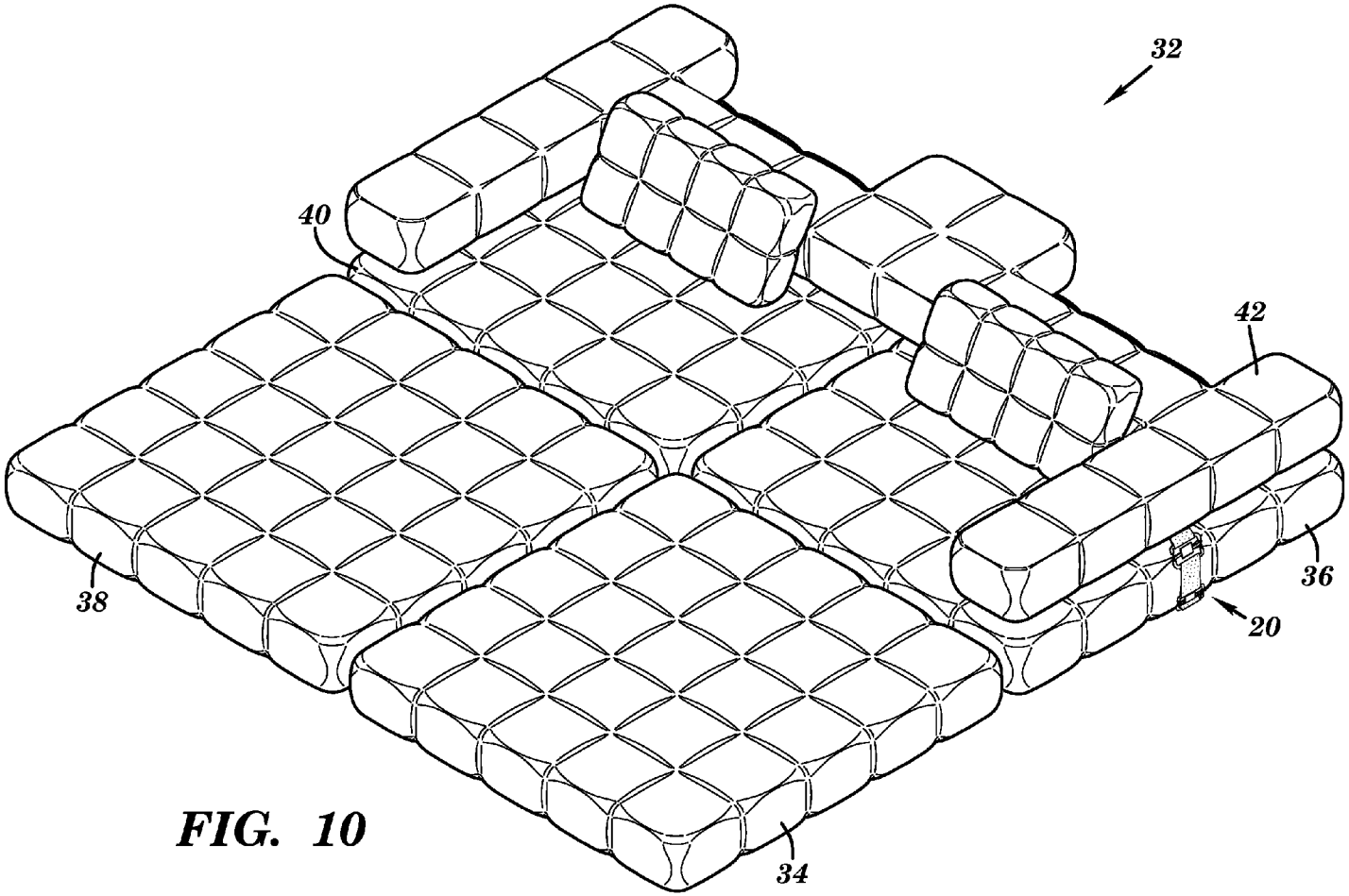
FIG. 10 shows an isometric view of the inflatable furniture system of FIG. 8 deployed as a lounge according to embodiments of the present invention.
Figure 11:
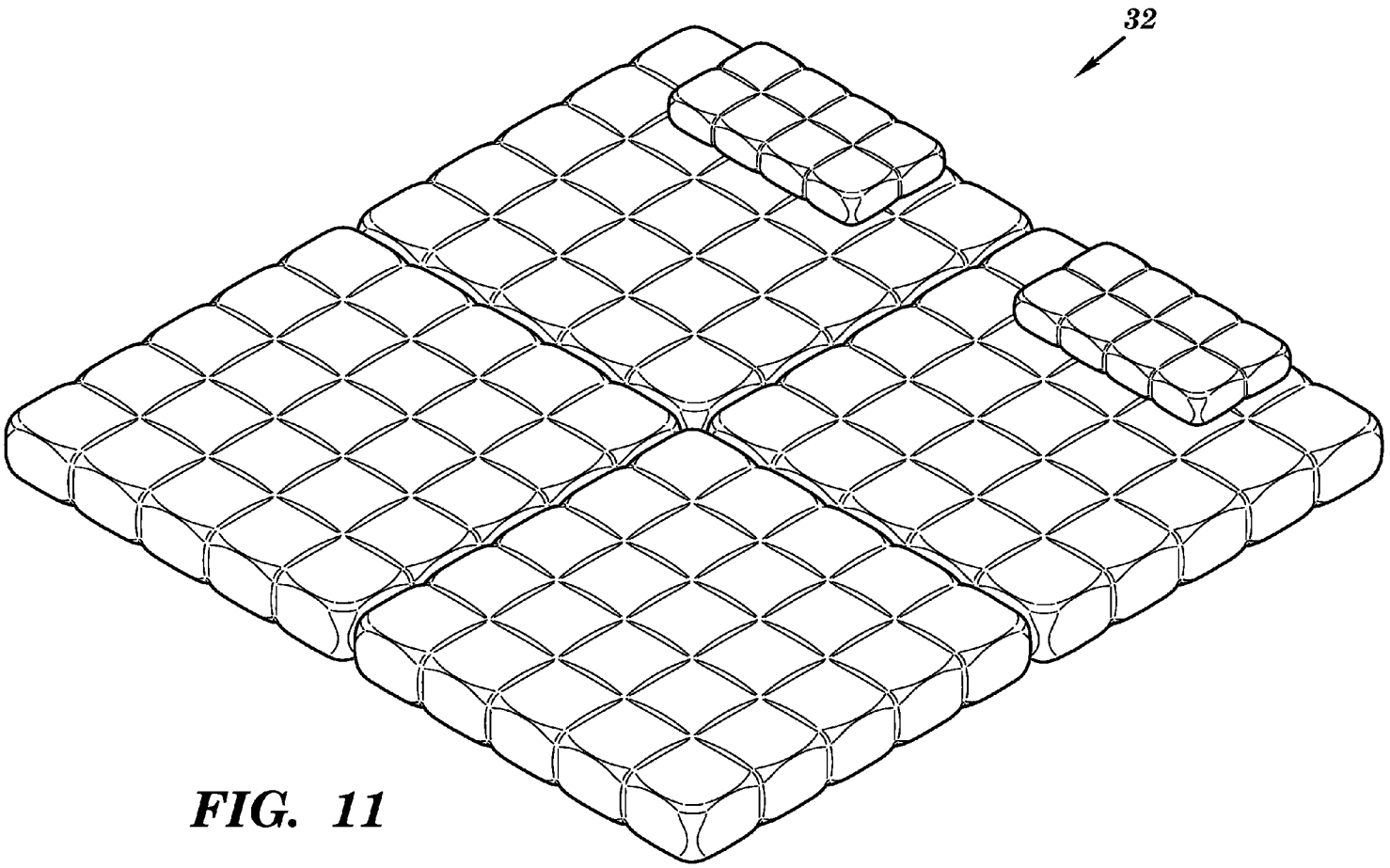
FIG. 11 shows an alternative lounge arrangement.

FIG. 10 depicts inflatable sofa system 32 redeployed as a double lounge. In this configuration, support cushions 34, 38 are positioned horizontally (edge-to-edge) to seat cushions 36, 40, respectively, and secured beneath the cushions as shown in FIG. 3 using S-clips. FIG. 11 depicts the inflatable sofa system 32 as a double lounge without the back/armrest 42.

Figure 12:
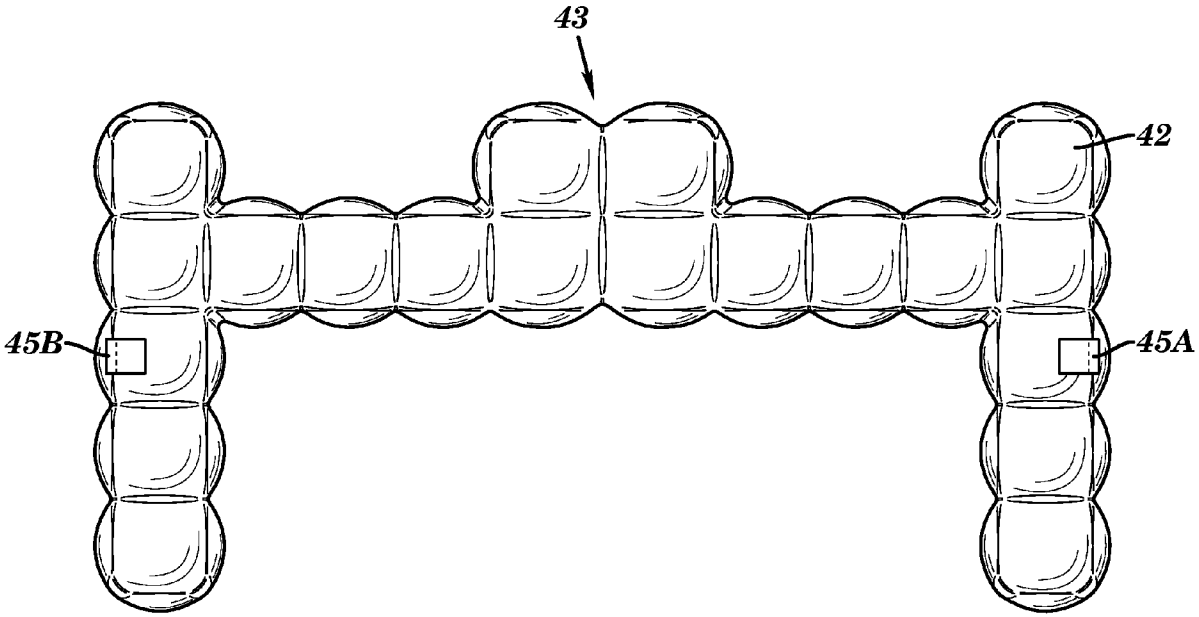
FIG. 12 shows an alternative H-shaped back/armrest according to embodiments of the invention.

FIG. 12 depicts the bottom side of modified H-shaped back/armrest 42 for use with sofa 32. Modified H-shaped back/armrest 42 provides the H-shaped configuration, but also includes a bump-out section 43 that provides additional support for the backrest. Also shown are attachment loops 45A, 45B. Like the H-shaped back/armrest shown in FIGS. 7A, 7B, modified H-shaped back/armrest 42 includes two substantially straight armrests arranged perpendicular to a substantially straight backrest surface, wherein the backrest meets each of the armrests along a central portion (versus and end portion) of each armrest. Thus, when stacked on cushions (not shown), the backrest is not positioned at the back of the cushion (except for the bump-out section), but more centrally to provide better support and comfort.

Figure 13:
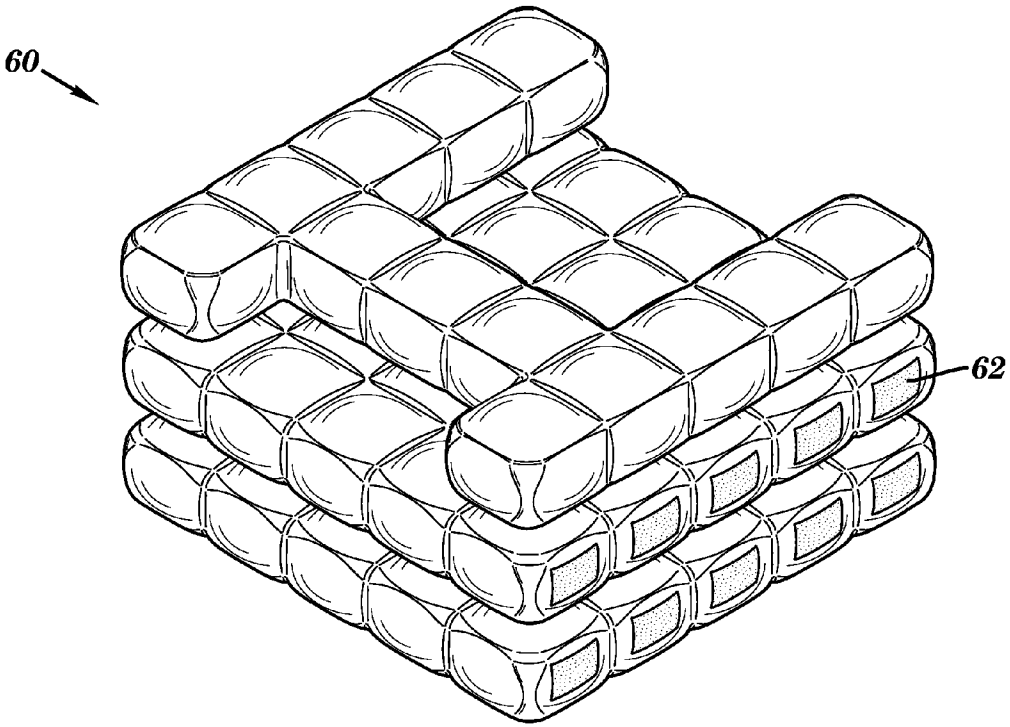
FIG. 13 shows an isometric view of an inflatable chair that utilizes hook and loop attachments according to embodiments of the invention.
Figure 14:
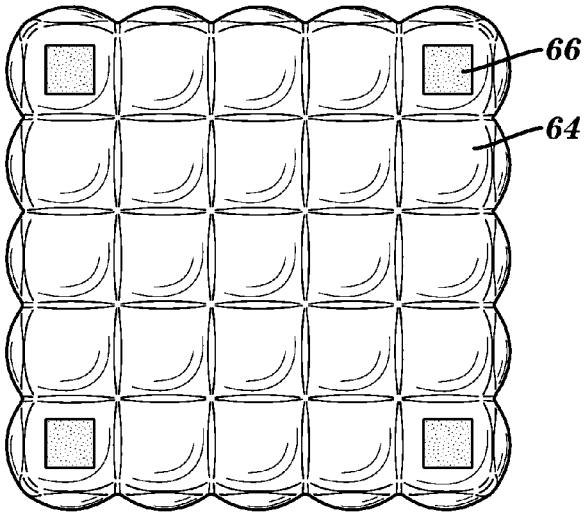
FIG. 14 shows a top view of a cushion that utilizes hook and loop attachments according to embodiments of the invention.
Figure 15:
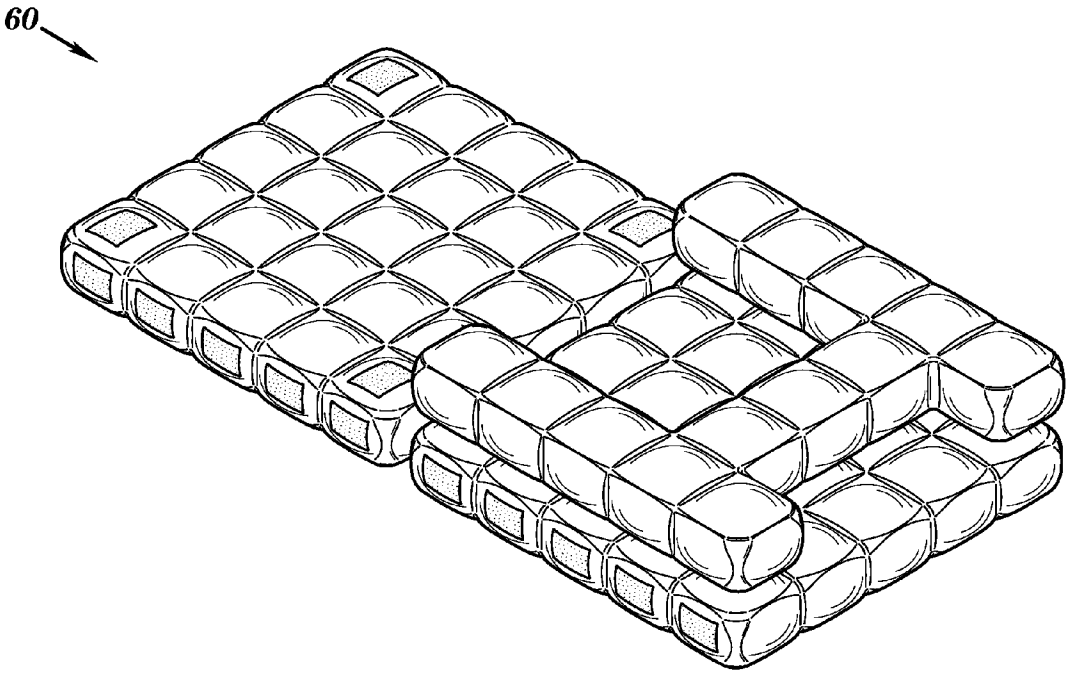
FIG. 15 shows the inflatable chair of FIG. 13 deployed as a lounge utilizing hook and loop attachments according to embodiments of the invention.

FIGS. 13-15 depict an alternative embodiment of an inflatable chair 60 using hook and loop fasteners (e.g., Velcro) to attach adjacent chair sections. FIG. 13 depicts hook and loop fasteners 62 positioned about an edge of a cushion for attaching cushions horizontally to each other (i.e., edge to edge). In this case, two of the four edges would have "hook" interfaces and the other two edges would have "loop" interfaces. FIG. 14 depicts a cushion 64 with hook and loop fasteners 66 positioned on a surface for attaching stackable sections. In this case, a first (e.g., top) surface may have "hook" interfaces and a second (e.g., bottom) surface may have "loop" interfaces. FIG. 15 shows the chair 60 in a lounge position connected with hook and loop fasteners.

Given the ease with which arm/backrest and cushion sections can be secured in both a stackable and horizontal manner, any number of configurations can be achieved when components from multiple chairs 10 and/or sofas 32 are combined. For example, it is common for multiple users to want to float next to each other on bodies of water. The modularity and attachment components described herein make it simple for multiple users to tether lounges, or cushions to each other for a shared floating experience.

In an alternative embodiment, couch and sofa sections may be secured using other known mechanisms, e.g., using hook and loop fasteners such as Velcro®, clips and rings, etc. Using the hook and loop approach, cushions, etc., may for example have hook and loop fasteners located at various locations on surfaces to allow sections to easily connect to each other.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

It is noted that positional terms such as upper, lower, top, bottom, etc., are not intended to limit the scope of the description or claims. Instead, such terms are intended to provide relative positioning employed during normal use of the invention in order to more easily explain the general implementation of the invention. For example, the term "bottom surface" of a cushion refers generally to a downwardly facing surface during normal use of the cushion as a seat.

What is claimed is:

1. An inflatable furniture system, comprising:

a pair of interchangeable inflatable cushion sections that are stackable upon each other to form a seat arrangement having a seat cushion and a support cushion, wherein a bottom surface of each cushion includes a plurality of attachment loops affixed thereto;

a substantially H-shaped inflatable arm/back rest that is stackable on the seat cushion and includes a bottom surface having a plurality of attachment loops affixed thereto;

a plurality of extension straps, each with two ends, wherein each end includes an attachment loop;

a plurality of S-clips, each configured to connect a pair of attachment loops;

wherein a first attachment loop of the seat cushion and an adjacent attachment loop of the support cushion are securable with a first pair of S-clips and a first extension strap, and wherein a second attachment loop of the seat cushion and an adjacent attachment loop of the substantially H-shaped inflatable arm/back rest are securable with a second pair of S-clips and a second extension strap.

2. The inflatable furniture system of claim 1, wherein the pair of interchangeable inflatable cushion sections have substantially square top and bottom surfaces.

3. The inflatable furniture system of claim 2, wherein each cushion includes four attachment loops located along a central portion of each edge of the bottom surface.

4. The inflatable furniture system of claim 1, wherein the substantially H-shaped inflatable arm/back rest includes two armrests, each armrest having an attachment loop located on a bottom surface along a central portion.

5. The inflatable furniture system of claim 1, wherein the interchangeable inflatable cushion sections can be arranged to form a lounge in which the support cushion is horizontally securable to the seat cushion by securing adjacent attachment loops of both cushions with an S-clip.

6. The inflatable furniture system of claim 1, wherein the seat arrangement comprises a chair.

7. The inflatable furniture system of claim 1, wherein the seat arrangement comprises a sofa, wherein the sofa include four interchangeable cushion sections.

8. An inflatable furniture system, comprising:

a pair of interchangeable inflatable cushions, wherein a bottom surface of each cushion includes a plurality of attachment loops affixed thereto;

a substantially H-shaped inflatable arm/back rest that includes a bottom surface having a plurality of attachment loops affixed thereto;

a plurality of extension straps, each with two ends, wherein each end includes an attachment loop; and a plurality of S-clips, each configured to connect a pair of attachment loops.

9. The inflatable furniture system of claim 8, wherein a seat arrangement is implemented with a first attachment loop of a first cushion stackably secured to an adjacent attachment loop of a second cushion with a first pair of S-clips and a first extension strap, and a second attachment loop of the first cushion stackably secured to an adjacent attachment loop of the substantially H-shaped inflatable arm/back rest with a second pair of S-clips and a second extension strap.

10. The inflatable furniture system of claim 8, wherein a lounge arrangement is implemented with a first attachment loop of a first cushion horizontally secured to an adjacent attachment loop of a second cushion with only a single S-clip.

11. The inflatable furniture system of claim 8, wherein the pair of interchangeable inflatable cushion sections have substantially square top and bottom surfaces.

12. The inflatable furniture system of claim 8, wherein each cushion includes four attachment loops located along a central portion of each edge of a bottom surface.

13. The inflatable furniture system of claim 8, wherein the substantially H-shaped inflatable arm/back rest includes two armrests, each armrest having an attachment loop located on a bottom surface along a central portion.

14. An inflatable furniture system, comprising:

a pair of interchangeable inflatable cushions;

a substantially H-shaped inflatable arm/back rest;

an attachment system, wherein the attachment system provides a first mechanism for stackably securing the interchangeable inflatable cushions and substantially H-shaped inflatable arm/back rest in a seat arrangement; and wherein the attachment system provides a second mechanism for horizontally securing the interchangeable inflatable cushions in a lounge arrangement.

15. The inflatable furniture system of claim 14, wherein at least one of the first mechanism and the second mechanism include a hook and loop system.

16. The inflatable furniture system of claim 14, wherein at least one of the first mechanism and the second mechanism include an S-clip having substantially parallel receiving elements for securing an attachment loop.

17. The inflatable furniture system of claim 14, wherein the pair of interchangeable inflatable cushion sections have substantially square top and bottom surfaces.

18. The inflatable furniture system of claim 14, further comprising a second pair of interchangeable inflatable cushion sections, wherein the attachment system includes a third mechanism for stackably securing the second pair of cushions horizontally adjacent a first pair of interchangeable inflatable cushion sections.

19. The inflatable furniture system of claim 18, wherein the attachment system includes a fourth mechanism for horizontally securing the second pair of cushions horizontally adjacent the first pair of interchangeable inflatable cushion sections.

20. The inflatable furniture system of claim 14, wherein the substantially H-shaped inflatable arm/back rest includes two substantially straight armrests arranged perpendicular to a substantially straight backrest, wherein the backrest meets each of the armrests along a central portion of each armrest.

* * * * *